United States Patent [19]

Rebentisch et al.

[11] 3,979,529

[45] Sept. 7, 1976

[54] ELECTROSTATIC APPLICATION OF THERMOPLASTIC ADHESIVE

[75] Inventors: Hans W. Rebentisch, Frankfurt; Gerhard W. Steinmeyer, Hunoldstal, Taunus, both of Germany

[73] Assignee: USM Corporation, Boston, Mass.

[22] Filed: Jan. 16, 1975

[21] Appl. No.: 541,652

Related U.S. Application Data

[62] Division of Ser. No. 392,034, Aug. 27, 1973, Pat. No. 3,881,447.

[52] U.S. Cl. ..... 427/25; 118/624; 118/638; 239/3; 427/27; 427/32

[51] Int. Cl.[2] ..... B05D 1/06

[58] Field of Search ..... 427/25, 27, 32; 239/3, 239/15; 118/624, 638

[56] References Cited

UNITED STATES PATENTS

| | | | |
|---|---|---|---|
| 2,128,907 | 9/1938 | Benner et al. | 427/25 |
| 3,329,125 | 7/1967 | Grossteinbeck et al. | 118/638 |
| 3,513,810 | 5/1970 | Jackson | 427/27 |

FOREIGN PATENTS OR APPLICATIONS

| | | | |
|---|---|---|---|
| 933,250 | 8/1963 | United Kingdom | 427/25 |

*Primary Examiner*—John H. Newsome
*Attorney, Agent, or Firm*—Aubrey C. Brine; Richard Burns Megley; Vincent A. White

[57] ABSTRACT

Apparatus is provided for applying a well-defined strip of thermoplastic adhesive in powder form to a substrate. Powdered adhesive material is received from a hopper supply into compartments arranged around the periphery of a rotatable transporter wheel. The wheel, by rotation, carries the adhesive to a delivery station where, owing to the presence of a strong electrostatic field between the wheel and an electrode, the adhesive is drawn from the wheel compartments and onto the substrate, to which it adheres. The substrate is moved through the apparatus at an appropriate speed, in comparison with that of rotation of the wheel, such that a continuous uniform strip of adhesive is applied to the substrate.

4 Claims, 4 Drawing Figures

ELECTROSTATIC APPLICATION OF THERMOPLASTIC ADHESIVE

This is a division of application Ser. No. 392,034, filed Aug. 27, 1973 now U.S. Pat. No. 3,881,447.

FIELD OF THE INVENTION

The invention concerns a device for the metered application of a melt-cement in powder-form, in a strip, onto a backing that is to be made to adhere at some later time. In the disclosed device the melt-cement is fed to a rotated wheel with defined zones for the reception of the cement, the wheel running through a high-tension field existing between two applier-electrodes, such that the backing is passed between the applier-electrodes and in confrontation with the wheel and the hot-melt cement is precipitated onto the backing under the force exerted by the high-tension field.

BACKGROUND OF THE INVENTION

Devices are known similar to that shown in U.S. Pat. No. 2,820,716. In the device described in that Patent, the powder trickles past on the wheel which is provided with a dielectric coating on its outer surface, in delimited zones. Opposite the wheel, and stationary relative to it, is situated an electrode which causes the charging of the dielectric material so that the powder, on its way to the applying-station, is attracted to the wheel. Thus, on the way to the applying-station, only the attractive-force of the electrical charge of the dielectric operates upon the powder, whereby only relatively small attraction forces occur, which in addition, constantly decrease during the rotation of the wheel due to the decline in electrical charge arising from the impossibility of complete insulation. With this device, therefore, one can only achieve applications similar to a sprinkling of dust.

SUMMARY OF THE INVENTION

By contrast, the invention has the basic aim of achieving increased thicknesses in the application of the powder-form melt-adhesive. This is attained by the expedient that the one applier-electrode is contained as a rod electrode in the wheel which transports the powder in recesses which have means of limiting the height of filling.

With such a device, powder-form melt-adhesive is delivered constantly by the wheel in defined quantities, and then, under the effect of the high-tension field, is deposited in a strip onto a backing that is guided along over it. In this manner, the rod electrode ensures that, from the point of delivery of the powder to the wheel, until the point of application on the backing, a strong high-tension field can operate upon the powder being transported on the wheel, whereby one can, entirely as one wishes, adjust the required strength of the high-tension field by employing a correspondingly high voltage. In this structure, a coaxial rod electrode fits directly into the wheel, so that any special electrode arrangements inside the wheel at the applying station are rendered superfluous. When the powder comes into the zone of the second applying-electrode, opposite the wheel at the point where the desired transfer of the powder onto the backing takes place, the powder here undergoes a reversal of polarization, which extracts the powder out of the recesses in the wheel and allows it to drift in the direction of the backing.

As a means for limiting the height of the filling in the recesses, (which can consist of chambers provided on the periphery of the wheel) there is provided a casing that rotates with the wheel and closes-off the chambers, such that practically no melt-adhesive can fall out of the chambers from the effect of gravity. The casing is advantageously designed as an endless belt, enclosing the periphery of the wheel and traveling with it.

It is also possible to construct the recesses as a ring-groove, facing upwards, in the edge of a rotatable plate. In this case, a belt rotating with the wheel is not required since in this instance a spontaneous falling-out of melt-adhesive from the groove is not possible.

Since with the last mentioned device the melt-adhesive is to a certain extent "sucked" out of a section of a ring-groove, this gives rise to a more or less broad strip of powder-form melt-adhesive on the backing, according to the diameter of the ring-groove. Also, the smaller the diameter of the plate, the greater tendency there is for the melt-adhesive to be applied along a relatively broad strip. By contrast, the device described above permits the application of particularly narrow strips, the breadth of which depends essentially only upon the corresponding width of the chambers in the rotatable wheel.

BRIEF DESCRIPTION OF THE DRAWINGS

In the drawings, exemplary embodiments of the invention are represented, wherein.

DESCRIPTION OF THE PREFERRED EMBODIMENT

Figure 1:
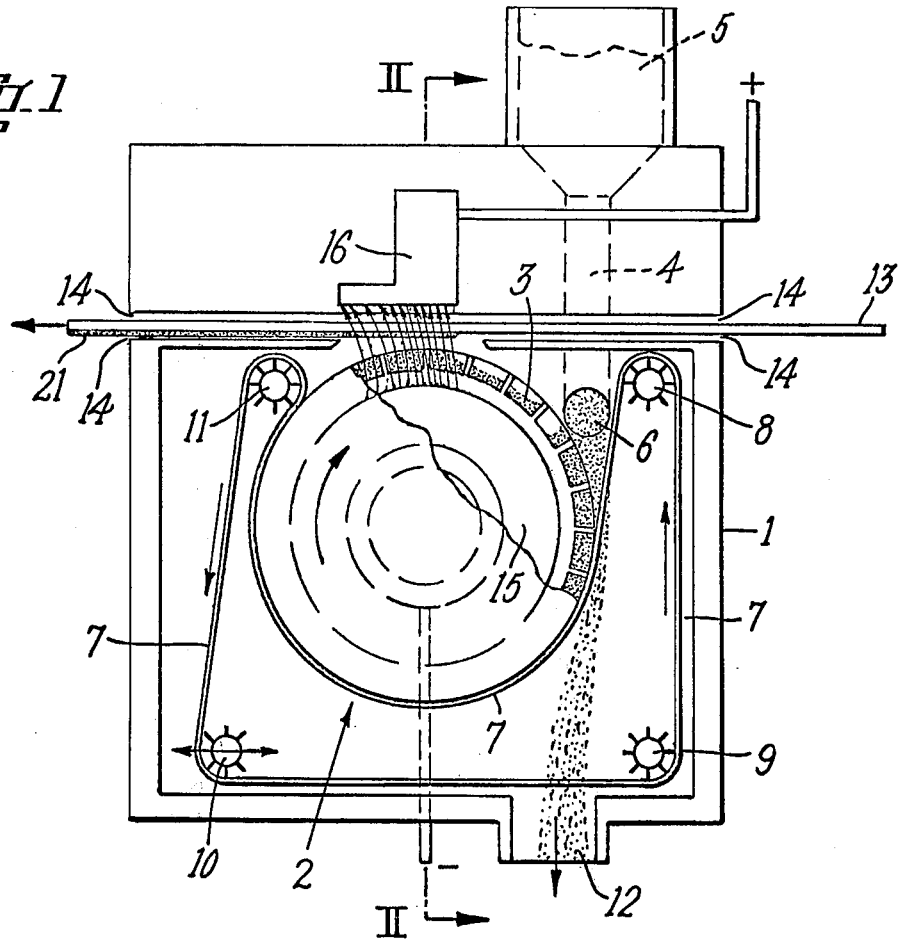
FIG. 1 shows a device according to the invention with a wheel that is provided with chambers on its periphery.
Figure 2:
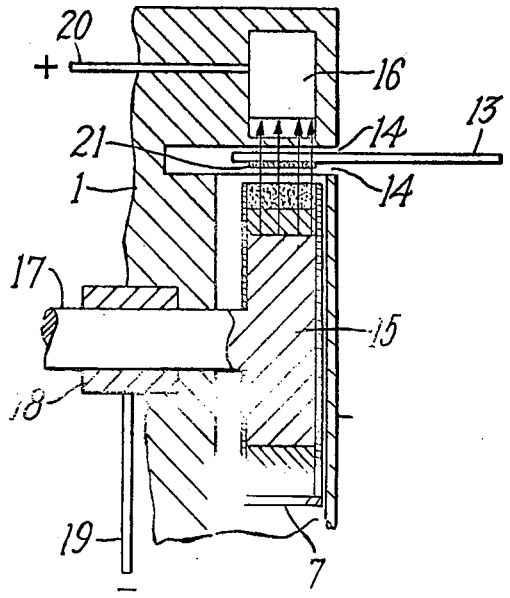
FIG. 2 depicts the same device as in FIG. 1 taken in section along the line II-II of FIG. 1.

The device represented in FIG. 1 has a casing 1 in which is rotatably mounted a wheel 2 serving as a transporter. The wheel 2 rotates in the direction of the arrow, and its periphery, is provided with the chambers 3 which are filled with the powder-form melt-adhesive (represented by the dots). The filling of the chambers 3 with the melt-adhesive takes place by means of a feed-pipe 4 which protrudes downward out of a reservoir 5 filled with the powder-form melt-adhesive. At its lower end, the feed-pipe 4 has an orifice 6 which is so situated that it is practically closed off by the surrounding construction elements, an element about which more detail will be given below.

The chambers 3, on their way from the orifice 6 to about a mirror-image opposite position, are closed-off by a cover, i.e. by a conjointly-traveling endless belt 7. This belt is wound round the wheel 2 in such a way that practically no melt-adhesive can fall out of the chambers 3 from the effect of gravity. For this purpose, the belt 7 is guided around four guide-rollers 8, 9, 10, and 11. Thus, the only opening that still remains for the chambers 3 is in the upward direction, in which the powder-form melt-adhesive is then to be carried off in accordance with the further description.

In order to prevent the attachment of melt-adhesive particles onto the inner side of the belt 7 and their pressing against the guide-rollers 8, 9, 10 and 11, the latter are constructed like toothed wheels, so that any melt-adhesive deposited on the inner side of the belt 7 is continuously pushed off by the teeth of the guide-rollers.

The guide-roller 10 can be moved sideways as indicated by the double arrow, and hence serves as a tensioning-roller. Any melt-adhesive powder clinging to the inner side of the belt 7 in the direction of the guide-roller 8 will fall off the belt 7 and arrive in a waste-pipe 12, out of which it trickles down and can be taken up to the reservoir again.

Above the wheel 2, and in a manner that needs no explanation here, for an understanding of the invention, a cardboard strip 13, serving as backing for the melt-adhesive, is guided. The strip 13 is moved forward through a slot 14 in the casing 1, whereby it passes through an electrical high-tension field which brings about the strip-shaped application of the melt-adhesive. Serving as a means for the production of the high-tension field are two applier-electrodes 15 and 16, of which the applier-electrode 15 is fitted coaxially in the wheel 2, while the applier-electrode 16, on the other side of the strip 13, confronts the latter as a surface-electrode. The high-tension electrode 15 receives its voltage via the shaft 17 which is guided in a bearing 18 to which the supply line 10 is connected. The supply-line 20 leads to the high-tension electrode 16. The casing 1 consists of an insulating material so that no short-circuit can occur between the electrode 16 and the bearing 18.

Under the effect of the high-tension field (which can be in the order of 15,000 to 20,000 volts) created between the applier-electrodes 15 and 16, the melt-adhesive particles migrate out of the chambers 3, upwards against gravity, and impinge upon the strip 21, from below, as a strip 21 on the cardboard strip 13, where due to adhesion and as a consequence of their lightness, they remain attached. The cardboard strip 13 and the wheel 2 are, moreover, moving at a synchronized speed, so that a strip of powder 21 with a specified quantity of powder is obtained, which finally extends along the whole of the cardboard strip 13 passed through the equipment. One can also adjust the thickness of the strip 21 as desired. The faster the cardboard 13 is moving forward in relation to the wheel 15, the thinner will be the layer of the powder-strip 21. The cardboard strip 13 is thereby prepared for subsequent cementing to any other object.

Figure 3:
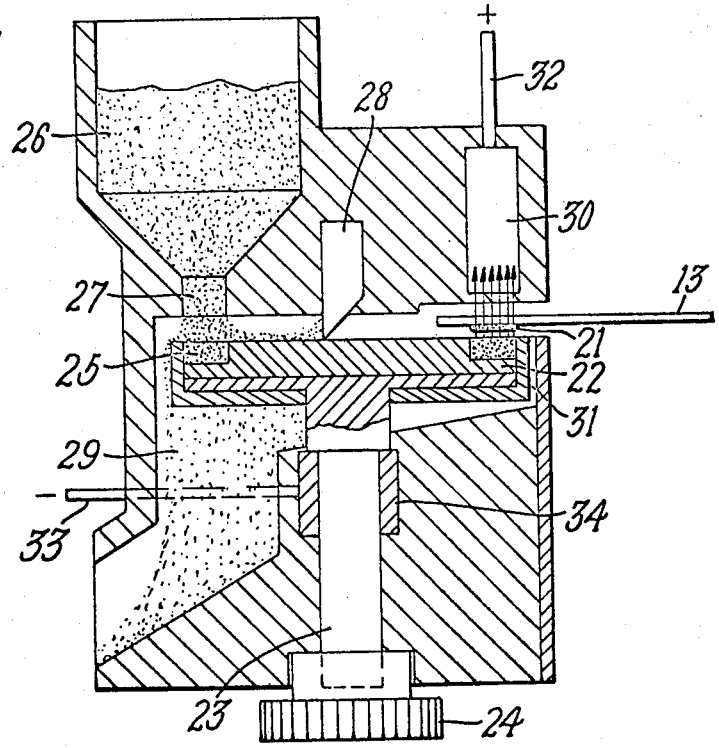
FIG. 3 shows a device according to the invention with a wheel constructed as a plate.

In the device represented in FIG. 3, the plate 22 is used as a conveyor for the melt-adhesive powder, being secured onto the upper end of the vertically-guided shaft 23. The shaft 23 is driven by gearwheel 24 in a manner which is not of interest for a full description of the present invention. The ring-groove 25 is formed axially into the plate 22, and is filled with the powder-form melt-adhesive (see dots). The melt-adhesive thus trickles out of the reservoir 26 and downward through the feed-pipe 27, then out of the latter into the ring-groove 25. As it is possible in this operation for the melt-adhesive to pile-up in and near the ring-groove 25, the stripper 28 is provided for levelling-off the melt-adhesive in the ring-groove 25, this stripper extending outward from the middle of plate 22, essentially radially, and pressing lightly against the plate 22. With the rotation of plate 22, powder-material caught by the stripper 28 is stopped and, due to a slight obliquity of the positioning of stripper 28 relative to the radial direction, it is conveyed outward so that it can fall into the overflow-channel 29 and be taken up for re-use.

With the rotation of plate 22, adhesive-powder is conveyed into the ring-groove 25 from a point underneath the feed-pipe 27 to the opposite side of the plate 22 where the powder is exposed to the high-tension field. The high-tension field is here produced by means of two applier-electrodes 30 and 31, of which the applier-electrode 30 is designed as a surface-electrode above the plate 22 while the applier-electrode 31 forms a round disc underneath the plate 22. The spatial limit of the high-tension field is therefore essentially determined by the upper applier-electrode 30, which can be constructed round or rectangular in the dimensions of the desired width of the application of adhesive. The applier-electrode 30 receives its voltage via the supply-line 32, while the applier-electrode 31 receives its voltage via the supply-line 33, the metallic bearing 34 and the metallic shaft 23. Over this path there thus exists a direct metallic, and therefore electrically effective, contact. Under the effect of the high-tension field, melt-adhesive particles are then drawn upward out of the ring-groove 25 and precipitated upon the cardboard strip 13, from below, in the shape of a strip of powder 21. Here also, the thickness of the powder-strip 21 is dependent upon the relation of the forward-feed speed of the cardboard strip 13 and the rate of rotation of the plate 22.

Figure 4:
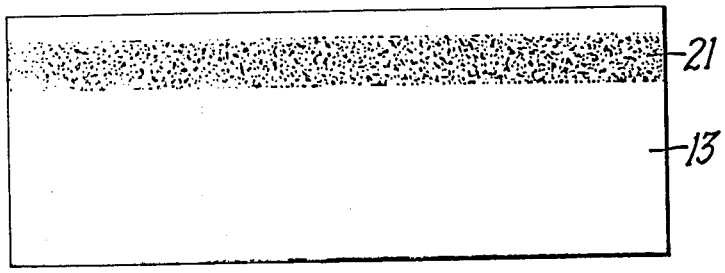
FIG. 4 shows a backing coated with the powder-form melt-adhesive along a strip.

In FIG. 4 is shown how a cardboard strip 13, onto which a powder-strip 21 has been applied, appears. As can be seen, the powder-strip 21 extends uniformly in the lengthwise direction of the cardboard strip 13, and thereby, there is an application of powder of definite width and height.

On all the devices as described above, the applier-electrodes are in each case at such a distance that, on the one hand, full effect is exerted on the adhesive-powder while, on the other hand, the cardboard strip 13 together with the respective conveyor can be passed between the applier-electrodes without hindrance. In each example, the cardboard strip is not touched in the zone of the powder-strip that has been applied, and hence the powder-strip 21 can reliably adhere to the cardboard-strip 13 until the activation of the adhesive.

Having thus described our invention, what we claim as new and desire to secure by Letters Patent of the United States is:

1. A method of applying a powder-melt adhesive in the form of a strip to a backing material, which strip is to be subsequently used to adhere the backing, comprising the steps of:

depositing the powder-melt adhesive onto a moving member having an electrode integral therewith;

providing a stationary electrode along the path of said moving member downstream of the point of adhesive deposit and in spaced relation with the powder melt adhesive on the member;

feeding the backing through the space between said stationary electrode and the powder-melt adhesive;

continuously applying a voltage of predetermined polarity to the integral electrode at least during the travel of said moving member from the point of depositing the powder-melt adhesive on the member to the point of positioning of the powder-melt material proximate the stationary electrode; and applying a voltage of opposite polarity to the stationary electrode such that, from the point of deposit of the powder-melt adhesive on the member to a point proximate the stationary electrode the powder melt adhesive is subjected to a substantially constant high tension field and the adhesive is subjected to a reversal of polarization when proximate the stationary electrode to extract the adhesive from the member and draw the adhesive from the member to the backing.

2. The method of claim 1 wherein said member on which the powder-melt adhesive is deposited comprises a wheel and said wheel is rotated relative to said spaced electrode during application of the powder-melt adhesive onto said backing.

3. The method of claim 2 which further includes the step of limiting the quantity of powder-melt adhesive on said member during the application of the powder-melt onto said backing by removing excess material from the member prior to said powder-melt adhesive being drawn from said member.

4. The method of claim 1 which further includes the step of limiting the quantity of powder-melt adhesive on said member during the application of powder-melt onto said backing by removing excess material from the member prior to said powder-melt adhesive being drawn from said member.

* * * * *